US009333503B2

(12) United States Patent
Zantl et al.

(10) Patent No.: US 9,333,503 B2
(45) Date of Patent: May 10, 2016

(54) SAMPLE CHAMBER WITH PARTING PLATE

(71) Applicant: ibidi GmbH, Martinsried (DE)

(72) Inventors: Roman Zantl, Baldham (DE); Elias Horn, München (DE)

(73) Assignee: ibidi GmbH, Martinsried (DE)

( * ) Notice: Subject to any disclaimer, the term of this patent is extended or adjusted under 35 U.S.C. 154(b) by 416 days.

(21) Appl. No.: 13/705,759

(22) Filed: Dec. 5, 2012

(65) Prior Publication Data

US 2013/0171043 A1 Jul. 4, 2013

(30) Foreign Application Priority Data

Dec. 12, 2011 (EP) ..... 11193029

(51) Int. Cl.
*B01L 3/00* (2006.01)

(52) U.S. Cl.
CPC ..... *B01L 3/508* (2013.01); *B01L 2300/0851* (2013.01)

(58) Field of Classification Search
None
See application file for complete search history.

(56) References Cited

U.S. PATENT DOCUMENTS

| | | | | |
|---|---|---|---|---|
| 4,741,619 | A * | 5/1988 | Humphries et al. | 356/246 |
| 4,797,259 | A * | 1/1989 | Matkovich et al. | 422/534 |
| 5,540,891 | A | 7/1996 | Portmann et al. | |
| 5,795,748 | A * | 8/1998 | Cottingham | 435/91.2 |
| 6,171,780 | B1 * | 1/2001 | Pham et al. | 435/4 |
| 2003/0012692 | A1 * | 1/2003 | Lemee et al. | 422/57 |
| 2010/0067105 | A1 | 3/2010 | Egeler et al. | |

FOREIGN PATENT DOCUMENTS

| | | | |
|---|---|---|---|
| EP | 0648536 | A1 | 4/1995 |
| WO | 2008149914 | A2 | 12/2008 |

* cited by examiner

*Primary Examiner* — Jill Warden
*Assistant Examiner* — Julie Tavares
(74) *Attorney, Agent, or Firm* — IP Strategies

(57) ABSTRACT

The invention comprises a sample chamber for microscopic examinations, comprising a reservoir for receiving a sample, the reservoir being defined by a bottom plate and a side wall, and a parting plate disposed in the reservoir and being parallel to the bottom plate, the parting plate in the reservoir being disposed at a height which is lower than the minimum height of the side wall, so that it divides the reservoir into an upper and a lower partial reservoirs, the lower partial reservoir and the upper partial reservoir being laterally completely bordered by the side wall, and the upper and the lower partial reservoirs being connected by at least one inlet/outlet.

19 Claims, 3 Drawing Sheets

SAMPLE CHAMBER WITH PARTING PLATE

FIELD OF THE INVENTION

The present invention relates to a sample chamber for microscopic examinations comprising a reservoir for receiving a sample.

BACKGROUND OF THE INVENTION

In particular in the cell microscopy field, most diverse forms of sample chambers are known. Almost all sample chambers include structures for receiving a sample, for example in the form of microfluidic channels or reservoirs. Examples of such sample chambers are shown in EP 1 886 792 A2, WO 2008/149914 A1 WO 2005/079985, or DE 101 48 210.

Possible application fields for such sample chambers are in particular the molecule or cell microscopy fields. The samples under test are placed into a reservoir of the sample chamber together with a liquid and can then be examined with high-resolution methods (for example transmitted-light microscopy, fluorescence microscopy, confocal microscopy, etc.).

In such examinations, however, the formation of a meniscus, that means a bulge of the surface of the liquid, is disadvantageous. Microscoping without meniscus is important, for example, if contrast enhancement by means of phase-contrast microscopy is intended. Known sample chambers often have the disadvantage that filling or microscoping without meniscus is not easily possible due to the geometries.

Therefore, a sample chamber (incubation container) is known from WO 2008/149914 A2 in which a meniscus is to be prevented or minimized by a cover member. In this sample chamber, however, the outer surface of the sample chamber might be contaminated if liquid leaks from the inlet via which the liquid can be filled into the reservoir. Cross contamination with samples in adjacent reservoirs can neither be excluded in this case. Furthermore, a cover used for covering the sample chamber can be contaminated in this case.

BRIEF SUMMARY OF THE INVENTION

It is therefore the object of the present invention to provide a sample chamber for microscopic examinations which permits microscoping without meniscus and simultaneously involves a lower risk of contamination of the outer surface of the sample chamber.

This object is achieved by a sample chamber according to claim 1.

The inventive sample chamber for microscopic examinations comprises:

a reservoir for receiving a sample, wherein the reservoir is defined by a bottom plate and a side wall, and a parting plate disposed in the reservoir and being in parallel to the bottom plate, wherein the parting plate is disposed in the reservoir at a height which is lower than the minimum height of the side wall, so that it divides the reservoir into an upper and a lower partial reservoir, the lower partial reservoir and the upper partial reservoir being laterally completely bordered by the side wall, and wherein the upper and lower partial reservoirs are connected by at least one inlet/outlet.

In such a sample chamber, microscoping without meniscus is possible by filling a liquid under test into the lower partial reservoir, so that the fill height completely wets the lower surface of the parting plate. The liquid can be introduced into the lower partial reservoir via the inlet/outlet. By the parting plate being disposed at a height which is lower than the minimum height of the side wall, the upper partial reservoir is also laterally completely bordered by the side wall. Consequently, it is possible to prevent or at least minimize a contamination of the outer surface of the sample chamber or a cross contamination if excessive liquid leaks from the inlet/outlet. In other words, leaking liquid would first be collected in the upper reservoir without escaping from the reservoir and thus causing a contamination of the outer surfaces of the sample chamber. The excessive liquid in the upper partial reservoir can then be optionally removed by pipetting.

The reservoir can in particular be a reservoir for receiving a liquid. In this case, the sample can either correspond to a liquid or be suspended in a liquid. Possible samples can be, for example, cells.

The height of the side wall and/or the height at which the parting plate is disposed in the reservoir can be in particular measured from the bottom of the reservoir. In particular if the bottom surface of the reservoir is not plane, the height of the side wall and/or the height in the reservoir in which the parting plate is arranged can also be determined from a plane surface on which the sample chamber rests, in particular in operation. The height can in particular be measured up to the upper edge of the side wall.

The side wall of the reservoir can in particular completely laterally border the reservoir, so that a liquid filled into the reservoir cannot laterally leak from the reservoir. In other words, the side wall can be designed to surround the reservoir, where the side wall in particular does not comprise any passage openings.

The side wall can in particular be of a constant height. In this case, the minimum height of the side wall corresponds to the (constant) height of the side wall. However, the side wall can also be of a variable height.

So, the minimum height of the side wall can in particular correspond to the height up to which a liquid can be filled into the reservoir without leaking from the reservoir.

The height at which the parting plate is disposed can in particular be smaller than or equal to three fourths, in particular smaller than or equal to half, in particular smaller than or equal to one fourth of the minimum height of the side wall. Thus, the volume of the upper partial reservoir can be sufficiently large to temporarily receive excessive liquid from the lower partial reservoir to avoid a contamination of the outer surface of the sample chamber.

Parallel to the bottom plate can in particular mean in this context parallel to a plane region of the bottom plate, in particular where the sample chamber at least partially rests on this plane region in operation. Parallel to the bottom plate can also mean parallel to the region of the bottom plate on which the sample chamber rests in operation.

Parallel to the bottom plate can in particular mean that the angle between the bottom plate, in particular the plane region of the bottom plate, and the parting plate is smaller than 5°, in particular smaller than 1°.

The parting plate can be connected with the side wall, in particular with a side edge or with two opposite sides of the side wall. In particular, the parting plate might be connected only with one side edge or with two opposite sides of the side wall. In other words, the parting plate might not be connected with the side wall at least partially.

The parting plate can here be firmly connected to the side wall, in particular such that it cannot be removed from it without being destructed. For example, the side wall can be glued or welded to the parting plate. The side wall and the parting plate can also be integrally formed.

As an alternative, the parting plate can be loosely connected with the side wall. This permits, for example, to introduce relatively large objects into the lower partial reservoir and insert the parting plate only subsequently. This can help to achieve higher flexibility in view of the samples to be examined.

In particular, the sample chamber can be designed such that the parting plate is exchangeable. For this, in particular the upper partial reservoir can be open to the outside, so that the parting plate can be removed and/or inserted via this opening.

The side wall can comprise an in particular surrounding edge on which the parting plate loosely rests. This permits a simple and secure loose connection of the parting plate with the side wall. In particular, the height at which the parting plate is arranged can thereby be precisely determined. The edge can be in particular formed by a projection or a shoulder.

As an alternative, however, it is also possible for the inner side of the side wall to taper towards the bottom plate, in particular to taper conically. By this, the parting plate could also be arranged at a certain height in the reservoir. In contrast to the step, this reversible connection can be designed to be somewhat more stable because a non-positive connection between the parting plate and the side wall can be formed by the tapering of the side wall.

As an alternative, one or more snap-in elements can also be introduced into or arranged at the side wall, so that the parting plate is thereby non-positively connected with the side wall.

The parting plate can have a geometry which corresponds to the geometry of the reservoir. Thus, an optimal surface for microscoping without meniscus can be provided. If the reservoir has, for example, a rectangular cross-section, the parting plate can also have a rectangular design.

The parting plate can be impermeable to liquids, porous or be designed as a membrane. If a membrane or another porous material is chosen for the parting plate, the pores can be dimensioned such that the liquid is drawn into the parting plate from the bottom, but due to the surface tension of the water, the upper side of the parting plate is not wetted. Here, pore sizes of 0.2 μm to 50 μm, in particular of 0.2 μm-20 μm, are advantageous.

The membrane can be formed as permeable or semi-permeable membrane.

The parting plate can have a thickness between 0.1 mm and 10 mm, in particular between 1 mm and 3 mm. This can offer sufficient stability of the parting plate.

The parting plate can in particular be rigid. This can prevent the parting plate from deforming under the pressure of a liquid disposed in the reservoir, whereby the meniscus could no longer be reliably prevented.

In particular, the parting plate can have a flexural strength which is larger than or equal to the flexural strength of a square plane plate consisting of PC (polycarbonate) having a side length of 1 cm, a constant thickness of 1 mm and a rectangular cross-section.

In particular, the flexural strength of the parting plate can be more than 190 000 $N \cdot mm^2$. The flexural strength corresponds to the product of the modulus of elasticity of the material of the parting plate and the geometrical moment of inertia of the parting plate. The modulus of elasticity can be determined by a method according to DIN 53457. The flexural strength can in particular relate to a flexion by a force perpendicular to the surface of the parting plate, in particular perpendicular to the surface of the parting plate which is disposed in parallel to the bottom plate.

The at least one inlet/outlet can be formed by an opening in the parting plate or by an opening between the parting plate and the side wall. This permits a simple and direct connection between the upper and the lower partial reservoirs.

The opening in the parting plate can be, for example, a through hole.

An opening between the parting plate and the side wall can at least partially be formed by a lateral recess in the parting plate. The lateral recess can be in particular provided in the region of a corner of the parting plate.

The opening between the parting plate and the side wall can also be at least partially formed by the parting plate being at least partially spaced apart from the side wall. By this, an oblong through opening between the parting plate and the side wall from the upper to the lower partial reservoir can be formed.

In case of a rectangular or square geometry of the reservoir, the opening can extend between the parting plate and the side wall over the complete length of one of the side walls. This permits an easier filling of the lower reservoir.

The opening, in particular in the form of a through hole in the parting plate, can have a diameter of at least 0.6 mm, in particular at least 0.8 mm. By this, the lower partial reservoir can be advantageously filled with a pipette because the dimensions of the opening thus at least correspond to the typical size of a pipette tip.

The upper and lower partial reservoirs can also be interconnected by two inlets/outlets which are in particular arranged at opposite sides of the reservoir. In particular when the inlets/outlets are arranged opposite to each other, a good venting during the filling of the lower partial reservoir can be achieved. The applicant surprisingly found out that by this, a more homogenous distribution of samples suspended in a liquid can be achieved in the lower partial reservoir.

However, more than two inlets/outlets could also be provided.

The ratio of the area of the parting plate to the base of the reservoir can be larger than 0.7, in particular larger than 0.8. By this, a maximum area for the microscopic examination can be provided.

The reservoir can in particular comprise a rectangular or square base. In principle, however, other arbitrary geometries of the reservoir, in particular of the base of the reservoir, are also possible.

With a rectangular or square geometry, the side walls can in particular comprise four side walls. The side walls can include an angle between 80° and 90°, in particular 90°, together with the bottom plate.

The reservoir can be open to the top. In other words, the reservoir can be designed such that the upper partial reservoir is freely accessible from outside. This can permit simple filling methods for introducing the samples into the lower partial reservoir. For example, pipetting methods can be permitted or facilitated by this.

The sample chamber can moreover comprise a further reservoir for receiving a sample, the further reservoir being bordered by the bottom plate and a side wall, and wherein a parting plate parallel to the bottom plate is arranged in the further reservoir, wherein the parting plate in the further reservoir is disposed at a height which is lower than the minimum height of the side wall, so that the further reservoir is divided into an upper and a lower partial reservoir, wherein the lower partial reservoir and the upper partial reservoir are laterally completely bordered by the side wall, and wherein the upper and the lower partial reservoirs are connected by at least one inlet/outlet.

In other words, the sample chamber can comprise several above-described reservoirs, each with a corresponding parting plate. By this, different examinations can be carried out with one single sample chamber.

Altogether, the sample chamber can comprise two or more reservoirs, each of the reservoirs comprising an above-described parting plate in the above-described arrangement. Preferably, the sample chamber can comprise exactly two, four, eight, twelve, 24, 48 or 96 reservoirs.

The reservoir and the further reservoir can partially comprise a common side wall. In other words, the reservoir and the further reservoir can be two adjacent reservoirs which share at least a portion of the side wall.

The sample chamber can moreover comprise a cover for closing the reservoir, where in particular the cover at least partially lies flat against the lateral outer surface of the side wall. By such a cover, the evaporation of liquid from the reservoir can be avoided or at least reduced.

The cover can seal the liquid reservoir in particular in a gastight or gas-permeable manner. With such a cover, moreover the risk of contamination of the liquid contained in the reservoir can be reduced. With a gastight sealing, examinations can be carried out in particular under a predetermined gas atmosphere.

Preferably, the cover and the side wall can be designed such that the lateral outer surface of the cover is aligned with the lateral outer surface of the side wall. By this, this device can be gripped more easily, in particular facilitating manual transport and rendering it more secure.

A flat abutment of the cover against the lateral outer surface can ensure a secure and tight connection between the cover and the side wall.

The cover and/or the side wall can comprise a snap-in element and/or a recess for receiving the snap-in element. In this manner, the cover can be firmly connected with the side wall. As an alternative, however, the cover can also rest loosely on the side wall, for example on an in particular surrounding edge at the outer surface of the side wall. The edge can be formed by a projection or by a shoulder.

The cover can in particular be designed such that it covers all reservoirs of the sample chamber.

The side wall and the parting plate can be integrally formed, in particular formed of a molded part. This permits a simple manufacture of the sample chamber.

The bottom plate can be in particular firmly connected with the side wall, in particular in a liquid-tight manner.

The bottom plate can be connected with the side wall by means of adhesives, solvents, UV treatment, radioactive treatment, laser treatment or thermal bonding. Thermal bonding can be effected across the surface or in strips, in particular only along the edge of the bottom plate and/or the side wall. This advantageously permits a firm connection of the side wall and the bottom plate. The side wall can also be connected with the parting plate by means of adhesives, solvents, UV treatment, radioactive treatment, laser treatment or thermal bonding.

The bottom plate can in particular be designed to be planar. Planar can in this context mean that two opposite surfaces each of the bottom plate are designed to be plane-parallel. The bottom plate can also be designed to be only partially planar.

The bottom plate can have a thickness of 1 μm to 300 μm, preferably 100 μm to 200 μm. Such a bottom plate advantageously permits the application of inverse microscopy. The thickness can correspond to the maximum thickness of the bottom plate. In case of a planar bottom plate, the thickness is constant.

In the region of the reservoir, the bottom plate can have an indentation. By this, the thickness of the bottom plate can be reduced in the region of the reservoir which can have a positive effect on its use for microscopic examinations, while the thickness is larger outside the reservoir region, which can have a positive effect on the stability of the sample chamber.

The bottom plate can also be designed as molded part.

The sample chamber can in particular comprise a cover plate which is firmly connected to the bottom plate, wherein a recess is provided in the cover plate, so that a reservoir is formed by the bottom plate and the recess. In other words, the side wall can be part of a cover plate connected with the bottom plate.

The bottom plate, the cover plate, in particular the side wall, and/or the parting plate can comprise a plastic, in particular COC (cycloolefin copolymer), COP (cycloolefin polymer), PE (polyethylene), PS (polystyrene), PC (polycarbonate), and/or PMMA (polymethylmethacrylate). The plastic can have a low double refraction (such as glass) and/or autofluorescence essentially equal to the autofluorescence of a conventional cover glass. Such a plastic of high-quality as regards optics can improve microscopic examinations, in particular in the application of fluorescence microscopy.

The bottom plate can comprise a flexible material, for example a film. However, the bottom plate can also consist of a glass, in particular of a cover glass.

The base of the sample chamber, in particular of the bottom plate, can have the dimensions of a conventional microscope slide, in particular a width of about 25.5 mm and a length of about 75.5 mm, or the dimensions of a multititer plate, in particular of a width of about 85.6 mm and a length of about 127.6 mm.

The reservoir can have a volume between 10 μl and 10 ml, preferably between 20 μl and 5 ml. The height of the reservoir can be between 25 μm and 20 mm, preferably between 0.1 mm and 5 mm. The in particular maximum diameter of the reservoir or the edge length of e.g. rectangular reservoirs can be between 0.5 mm and 50 mm, preferably between 1 mm and 25 mm.

If the side wall is part of a cover plate, this cover plate can comprise a planar region which is parallel to the bottom plate. The height of the sample chamber in a planar region of such a bottom plate can be between 0.5 mm and 10 mm, preferably between 1 mm and 2 mm, in particular 1.7 mm. If the cover plate of the sample chamber has an elevation in which a recess is formed, the volume of a reservoir formed in this manner can be between 50 μl and 3 ml, preferably between 80 μl and 2.5 ml. The height of an elevation, starting from a planar region of the cover plate, can be between 1 mm and 2 cm, preferably between 5 mm and 1 cm.

The inner surface of the reservoir can be at least partially hydrophilized. This can prevent or at least minimize the penetration of undesired substances, for example of hydrophobic solvents, into the material of the sample chamber. In particular, the inner surface of the sample chamber in the lower partial reservoir can be hydrophilized.

The inner surface of the reservoir can be at least partially hydrophilized by the introduction of plasma or of plasma waste gases or reactive gases, such as ozone or nitrogen oxide, into the reservoir.

The plasma can be directed into the lower partial reservoir in particular through the at least one inlet/outlet. This can permit an effective hydrophilization of a reservoir surface.

DESCRIPTION OF THE DRAWINGS

Further features and advantages of the invention will be illustrated below with reference to the exemplary figures. In the drawings.

DESCRIPTION OF THE INVENTION

Figure 1:
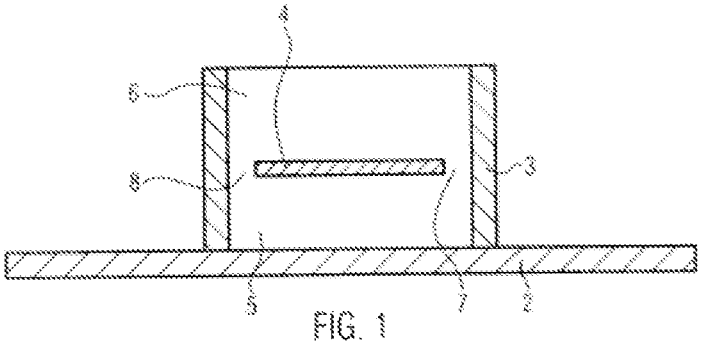
FIG. 1 shows a cross-sectional view of an exemplary sample chamber for microscopic examinations.

In FIG. 1, an exemplary sample chamber for microscopic examinations, for example for fluorescence microscopy, is shown. The exemplary sample chamber 1 comprises a bottom plate 2 and a side wall 3. A reservoir is defined by the bottom plate 2 and the side wall 3, the reservoir being open to the top.

A parting plate 4 is disposed in this reservoir such that the reservoir is divided into a lower partial reservoir 5 and an upper partial reservoir 6. The side wall 3 in this case comprises a constant height. The parting plate 4 is disposed at a height in the reservoir which is lower than the height of the side wall 3.

However, it is also possible for the reservoir to have a side wall 3 of a variable height. In this case, the parting plate is disposed at a height which is lower than the minimum height of the side wall.

Both the lower partial reservoir 5 and the upper partial reservoir 6 are laterally completely bordered by the side wall 3.

The lower partial reservoir 5 and the upper partial reservoir 6 are in this example arranged one upon the other in an aligned manner.

The upper partial reservoir 6 is connected with the lower partial reservoir 5 via a first inlet/outlet 7 and a second inlet/outlet 8. Through these inlets/outlets 7, 8, a sample, which is in particular suspended in a liquid, can be introduced into the lower partial reservoir 5. If the lower partial reservoir 5 is filled with a liquid such that the fill height completely wets the bottom side of the parting plate 4, no meniscus is formed.

When the lower partial reservoir 5 is being filled, liquid might escape through one of the inlets/outlets 7, 8 over the height of the parting plate 4. However, since the side wall 3 also laterally completely borders the upper partial reservoir 6, the risk of a contamination of the outer surfaces of the sample chamber 1 is reduced.

The height at which the parting plate 4 is arranged can in particular correspond to half the minimum height of the side wall 3 or less.

The flexural strength of the parting plate 4 can in particular be more than 191666 $N \cdot mm^2$. This corresponds to the flexural strength of a square parting plate with a thickness of 1 mm and a side length of 1 cm, consisting of polycarbonate. The flexural strength here refers to a flexion perpendicular to the surface of the parting plate 4 which is disposed in parallel to the bottom plate 2.

By such a rigid parting plate 4, a deformation of the parting plate 4 under the pressure of the liquid introduced into the reservoir can be prevented or at least minimized, whereby a meniscus can be prevented or minimized more reliably.

Figure 2:
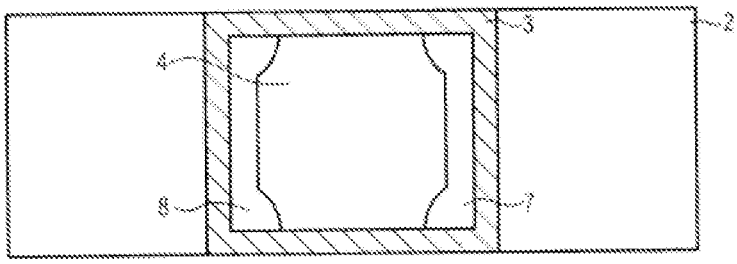
FIG. 2 shows a plan view onto an exemplary sa chamber according to FIG. 1.

FIG. 2 shows a plan view onto an exemplary sample chamber according to FIG. 1. It is obvious in this plan view that the two inlets/outlets 7, 8 are formed by the parting plate 4 being at least partially spaced apart from the side wall 3. In particular, the parting plate 4 is connected with only two opposite sides of the side wall 3. The parting plate 4 is spaced apart from two sides of the side wall 3, whereby a through opening between the upper partial reservoir 6 and the lower partial reservoir 5 is formed. The inlets/outlets 7, 8 this have the shape of a slot. Broadenings are provided at the ends of the slot-like openings. These can facilitate filling, for example with a pipette. These broadenings are formed by lateral recesses at the corners of the parting plate 4. The distance between the parting plate 4 and the side wall 3 in the region of the broadenings is more than 0.6 mm, in particular more than 0.8 mm.

In this example, the parting plate 4 is firmly connected to the side wall 3, for example by thermal bonding. As an alternative, however, the parting plate 4 could also be loosely connected to the side wall 3. For this, the side wall 3 could have an edge on which the parting plate 4 can loosely rest at least at two opposite sides.

Figure 3:
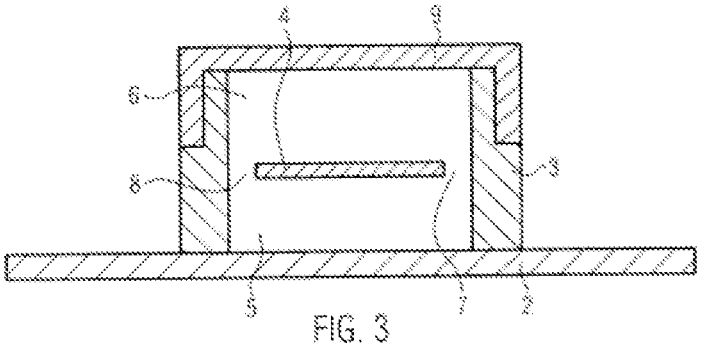
FIG. 3 shows a cross-sectional view of an exemplary sample chamber according to FIG. 1 with a cover.

FIG. 3 shows a further cross-sectional view of an exemplary sample chamber. Like the sample chamber of FIG. 1, this sample chamber has a bottom plate 2, a side wall 3, and a parting plate 4. The side wall 3 and the bottom plate 2 define a reservoir for receiving a sample. The parting plate 4 divides the reservoir into a lower partial reservoir 5 and an upper partial reservoir 6 which are connected by two inlets/outlets 7, 8.

In this example, the reservoir is closed by a cover 9. The cover 9 can close the reservoir in a gastight or gas-permeable manner. With such a cover, the risk of contamination of the sample contained in the reservoir can also be reduced. In case of a gastight sealing, examinations can be in particular carried out under a predetermined gas atmosphere.

In this example, the site wall 3 has an edge at its outer surface which is formed by a shoulder and on, which the cover 9 rests. The outer surface of the cover 9 is aligned with the outer surfaces of the side wall 3. The sample chamber can be gripped more easily thereby, facilitating in particular the manual transport and rendering it more secure. The cover 9 also flatly lies against the lateral outer surface of the side wall 3 in this example. This can ensure a secure and tight connection between the cover 9 and the side wall 3.

Figure 4:
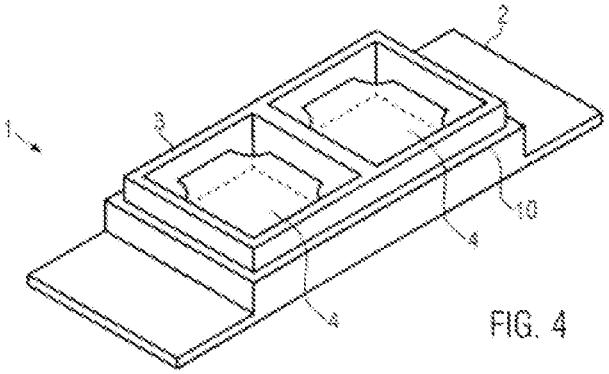
FIG. 4 shows a perspective view of a further exemplary sample chamber for microscopic examinations.

FIG. 4 shows a perspective view of a further exemplary sample chamber 1. In this sample chamber 1, two adjacent reservoirs are provided which are each defined by a side wall 3 and a bottom plate 2. In both reservoirs, a parting plate 4 parallel to the bottom plate 2 is arranged which is impermeable to liquids and divides the respective reservoir into a lower partial reservoir 5 and an upper partial reservoir 6 which are connected by inlets/outlets 7, 8.

The parting plate 4 could alternatively also be porous or designed as a membrane.

One can see an edge 10 at the outer surface of side wall 3 on which a cover for closing the reservoirs can rest.

Figure 5:
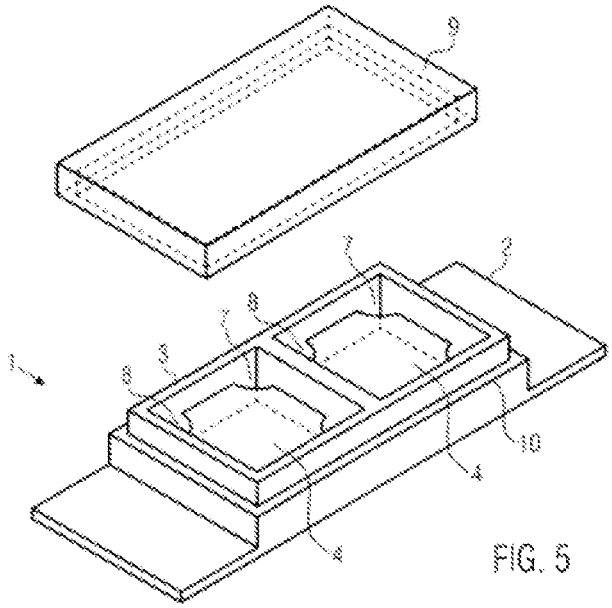
FIG. 5 shows a perspective view of an exemplary sample chamber according to FIG. 4 with a cover.

FIG. 5 shows an exemplary sample chamber according to FIG. 4 with a cover 9 for closing the reservoirs.

Figure 6:
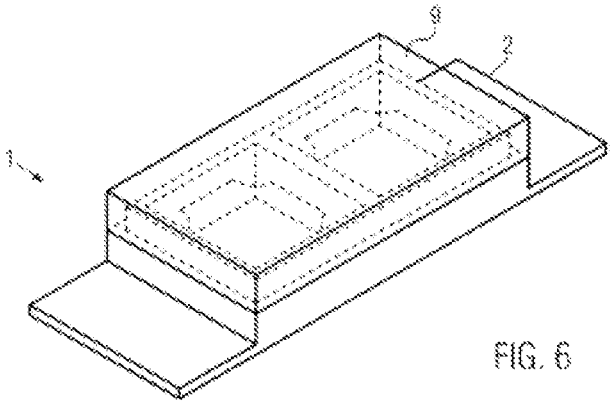
FIG. 6 shows a perspective view of an exemplary sample chamber according to FIGS. 4 and 5 with a cover.

In FIG. 6, the exemplary sample chamber of FIG. 5 is shown where both reservoirs are closed by the cover 9.

The inner surface of the reservoirs shown above, in particular the inner surface of the lower partial reservoir, can also be at least partially hydrophilized, that means they can comprise a hydrophilic layer. By such a hydrophilic layer, the migration of undesired substances, for example solvents, into the material of the sample chamber can be prevented or at least minimized.

The layer can have a surface tension of more than 70 mN/m, in particular more than 72 mN/m. In this manner, preferably hydrophilic properties are achieved.

A hydrophilic layer can be, for example, a $SiO_x$ layer. Such a hydrophilic layer can be achieved, for example, by means of plasma technologies where $SiO_x$ is deposited. $SiO_x$ has a surface tension of more than 72 mN/m.

Possible methods for such layers can be taken, for example, from B. Jacoby et al., "Abscheidung, Charakterisierung und Anwendung von Plasma-Polymerschichten auf HMDSO-Basis", Vakuum in Forschung und Praxis (2006), pages 12-18, or D. Hegemann et al., "Deposition Rate and Three-dimensional Uniformity of RF plasma deposited $SiO_x$ films", Surface and Coating Technology (2001), page 849.

The surface tension (or surface energy) is determined according to ISO 8296:2003 (plastics—films and sheetings—determination of the wetting tension, ISO 8296:2003). ISO 8296 (formerly DIN 53 364) regulates the assessment of the medium wettability of plastics. The criterion is the behavior of the edge of strokes of a brush with test inks. Test inks with different surface tensions are used for this. If the edge of the stroke of the brush contracts within 2 seconds, measurement will be repeated with the next lower value. If the edge of the stroke of the brush runs outwards, measurement will be repeated with the next higher value. The (critical) surface energy is the value of the test liquid whose edge stands still just for 2 seconds.

It will be understood that features mentioned in the above described embodiments are not restricted to these special combinations and are also possible in any other combinations. Moreover, the geometry of the reservoirs is not restricted to the square shape shown in the figures. Any other geometries are also possible. For example, the reservoirs can also have a cylindrical design.

The invention claimed is:

1. Sample chamber for microscopic examinations, comprising:

a first reservoir and a second reservoir, each for receiving a respective sample, wherein the first reservoir is defined b a bottom late and a respective side wall of the first reservoir and wherein the second reservoir is defined by the bottom plate and a respective side wall of the second reservoir, and a first parting plate disposed in the first reservoir and a second parting plate disposed in the second reservoir, wherein each said parting plate is arranged parallel to the bottom plate, wherein the respective parting plate is disposed in each said reservoir at a height that is lower than a minimum height of the respective side wall, so that it the respective parting plate divides the respective reservoir into an upper partial reservoir and a lower partial reservoir, wherein the lower partial reservoir and the upper partial reservoir of each of the first and second reservoirs are laterally completely bordered by the respective side wall, and wherein the upper and the lower partial reservoirs of each of the first and second reservoirs are connected by at least one inlet/outlet.

2. Sample chamber according to claim 1, wherein at least one said side wall has a constant height.

3. Sample chamber according to claim 1, wherein at least one of the first parting plate and the second parting plate is connected with the respective side wall.

4. Sample chamber according to claim 3, wherein at least one of the first parting plate and the second parting plate is loosely connected with the respective side wall.

5. Sample chamber according to claim 1, wherein at least one said side wall comprises a surrounding edge which the respective parting plate loosely rests on.

6. Sample chamber according to claim 1, wherein the at least one inlet/outlet is formed by an opening in the respective parting plate or an opening between the respective parting plate and the respective side wall.

7. Sample chamber according to claim 6, wherein the opening between the respective parting plate and the respective side wall is at least partially formed by a lateral recess in the respective parting plate.

8. Sample chamber according to claim 6, wherein the opening between the respective parting plate and the respective side wall is at least partially formed by the respective parting plate being at least partially spaced apart from the respective side wall.

9. Sample chamber according to claim 1, wherein the upper and lower partial reservoirs of at least one of the first reservoir and the second reservoir are connected by two said inlets/outlets.

10. Sample chamber according to claim 1, wherein a ratio of the area of at least one of the first parting plate and the second parting plate to a base of the respective reservoir is larger than 0.7.

11. Sample chamber according to claim 1, wherein at least one of the first reservoir and the second reservoir has a rectangular or square base.

12. Sample chamber according to claim 1, wherein the first reservoir and the second reservoir in some areas comprise a common side wall.

13. Sample chamber according to claim 1, moreover comprising a cover for closing at least one of the first reservoir and the second reservoir.

14. Sample chamber according to claim 1, wherein the inner surface of at least one of the first reservoir and the second reservoir is at least partially hydrophilized.

15. Sample chamber according to claim 1, wherein at least one of the first parting plate and the second parting plate is impermeable to liquids, is porous, or is designed as a membrane.

16. Sample chamber according to claim 10, wherein the ratio of the area of the at least one of the first parting plate and the second parting plate to the base of the respective reservoir is larger than 0.8.

17. Sample chamber according to claim 3, wherein the at least one of the first parting plate and the second parting plate is connected with a side edge or with two opposite sides of the respective side wall.

18. Sample chamber according to claim 9, wherein the two inlets/outlets are disposed at opposite sides of the respective reservoir.

19. Sample chamber according to claim 13, wherein the cover at least partially lies flatly against a lateral outer surface of the respective side wall.

* * * * *